US006109604A

United States Patent [19]

Chu et al.

[11] Patent Number: 6,109,604

[45] Date of Patent: Aug. 29, 2000

[54] MEDIA FEEDER

[75] Inventors: Mosi Chu, Setauket, N.Y.; Keng-Yin Sun, Hsinchu, Taiwan

[73] Assignee: Macro Technology International Inc., Ronkonkoma, N.Y.

[21] Appl. No.: 09/288,002

[22] Filed: Apr. 7, 1999

[51] Int. Cl.[7] ..... B65H 5/00

[52] U.S. Cl. ..... 271/10.11; 271/10.02; 271/10.01; 271/10.09; 271/121; 271/161; 271/265.02

[58] Field of Search ..... 271/10.01, 10.02, 271/10.03, 10.09, 10.1, 10.11, 110, 111, 121, 161, 265.02

[56] References Cited

U.S. PATENT DOCUMENTS

| | | | |
|---|---|---|---|
| 2,991,075 | 4/1961 | Wheeler et al. | 271/161 |
| 4,132,401 | 1/1979 | Gauronski | 271/256.02 |
| 5,172,898 | 12/1992 | Takahashi | 271/10.11 |
| 5,664,771 | 9/1997 | Nagatani et al. | 271/10.03 |
| 6,005,212 | 12/1999 | Lierde et al. | 271/265.02 |

*Primary Examiner*—H. Grant Skaggs
*Attorney, Agent, or Firm*—Ladas & Parry

[57] ABSTRACT

A paper feeder comprises a control unit; a pair of side plates; a feed module having two or more separate feed rollers; a transport module having two or more separate transport rollers; a pusher module having a belt assembly and at least one pusher roller disposed under the belt assembly, the belt assembly further having two or more parallel shafts and two or more belts each having a protrusion and fitted on the shafts, the protrusions corresponding to each other; a first driving mechanism having a first motor and a first transmission mechanism, the first motor being connected to the first transmission mechanism which is in turn connected to at least one of the feed rollers; a second driving mechanism having a second motor and a second transmission mechanism, the second motor being connected to the second transmission mechanism which is in turn connected to at least one of the pusher rollers; a third driving mechanism having a third motor and a third transmission mechanism, the third motor being connected to the third transmission mechanism which is in turn connected to at least one of the shafts of the belt assembly; a separation module having a slopped plate, a horizontal plate extending from the slopped plate and at least one tab extending downward from the horizontal plate; and a sensor module having a horizontal plate, a first sensor and a second sensor, the first sensor and the second sensor being disposed in the horizontal plate in a direction parallel to the side plates and opposite to the direction of paper feed.

8 Claims, 7 Drawing Sheets

MEDIA FEEDER

FIELD OF THE INVENTION

The present invention relates generally to a media feeder for separating the bottom piece of paper from a stack of paper above it and transporting it to a printer. The present invention can also be used for feeding other media, such as envelopes.

BACKGROUND OF THE INVENTION

Modern office equipment such as printers and copiers, are usually designed with an automatic pre-cut paper feeder. Hardly any office machine is equipped with an automatic envelope or other media feeder and provides instead only an automatic feeder for pre-cut paper. Some printers are provided with a slot for manual insertion of media such as envelopes. However, it is labor intensive and time consuming to manually feed a large number of envelopes (or other media) to be printed (or copied).

A difficulty in creating an automatic media feeder lies in a problem of "multiple feed." "Multiple feed" is associated with a bottom feed system and results from the situation where the weight of the stack of media is on the bottom piece thereof that is to be separated from the stack and moved by a feed roller. The friction between the bottom piece and the stack of media above the piece is proportional to the weight of the stack. It is obvious that the greater the weight of the stack of media is, the more the multiple feeding occurs.

U.S. patent application Ser. No. 09/017,248 filed by Mosi Chu, now abandoned, relates to a bottom media feeding device for media of various thicknesses. The media feeding device utilizes a plurality of rollers to separate a bottom piece of paper (or other media) from a stack of paper above it and utilizes a separation means to avoid the problem of "multiple feed". However, such device cannot avoid the problem of the improper orientation of the bottom piece of paper (media).

SUMMARY OF THE INVENTION

It is a primary objective of the present invention to provide a media feeder for supplying a variety of media to a printing apparatus.

It is another objective of the present invention to provide a media feeder which has a separation module for separating the bottom piece of paper from a stack of paper above it.

It is a further objective of the present invention to provide a media feeder with two optical sensors which sense the leading edge of the fed pieces of paper and then produce signals for optimizing the throughout of the feeder.

It is a fourth objective of the present invention to provide a media feeder which has protrusions for correcting the misalignment of the fed pieces of paper.

It is a further objective of the present invention to provide a media feeder which can buckle a stack of paper to be fed in a convex shape so as to solve the problem of "multiple feed".

To achieve the above objectives, the media feeder of the claimed invention comprises: a control unit; a pair of side plates; a feed module comprising two or more separate feed rollers; a transport module located adjacent to the feed module and comprising two or more separate transport rollers; a pusher module located adjacent to the transport module and comprising a belt assembly and at least one pusher roller disposed under the belt assembly, the belt assembly comprising two or more parallel shafts and two or more belts fitted on the shafts, the belts each having a protrusion thereon and the protrusions corresponding to each other; a first driving mechanism comprising a first motor and a first transmission mechanism, the first motor being connected to the first transmission mechanism which is in turn connected to at least one of the feed rollers; a second driving mechanism comprising a second motor and a second transmission mechanism, the second motor being connected to the second transmission mechanism which is in turn connected to at least one of the pusher rollers; a third driving mechanism comprising a third motor and a third transmission mechanism, the third motor being connected to the third transmission mechanism which is in turn connected to at least one of the shafts of the belt assembly; a separation module disposed adjacent to the feed module and comprising a slopped plate, a horizontal plate extending from the slopped plate and at least one tab extending downward from the horizontal plate; and a sensor module disposed adjacent to the transport module and having a horizontal plate, a first sensor and a second sensor, the first sensor and the second sensor being disposed in the horizontal plate in a direction parallel to the side plates and opposite to the direction of paper feed.

From the description of the preferred embodiments and with reference to the accompanying drawings, the structure and features of the subject invention will be better understood by those skilled in the art.

DETAILED DESCRIPTION OF THE PREFERRED EMBODIMENTS

Figure 1:
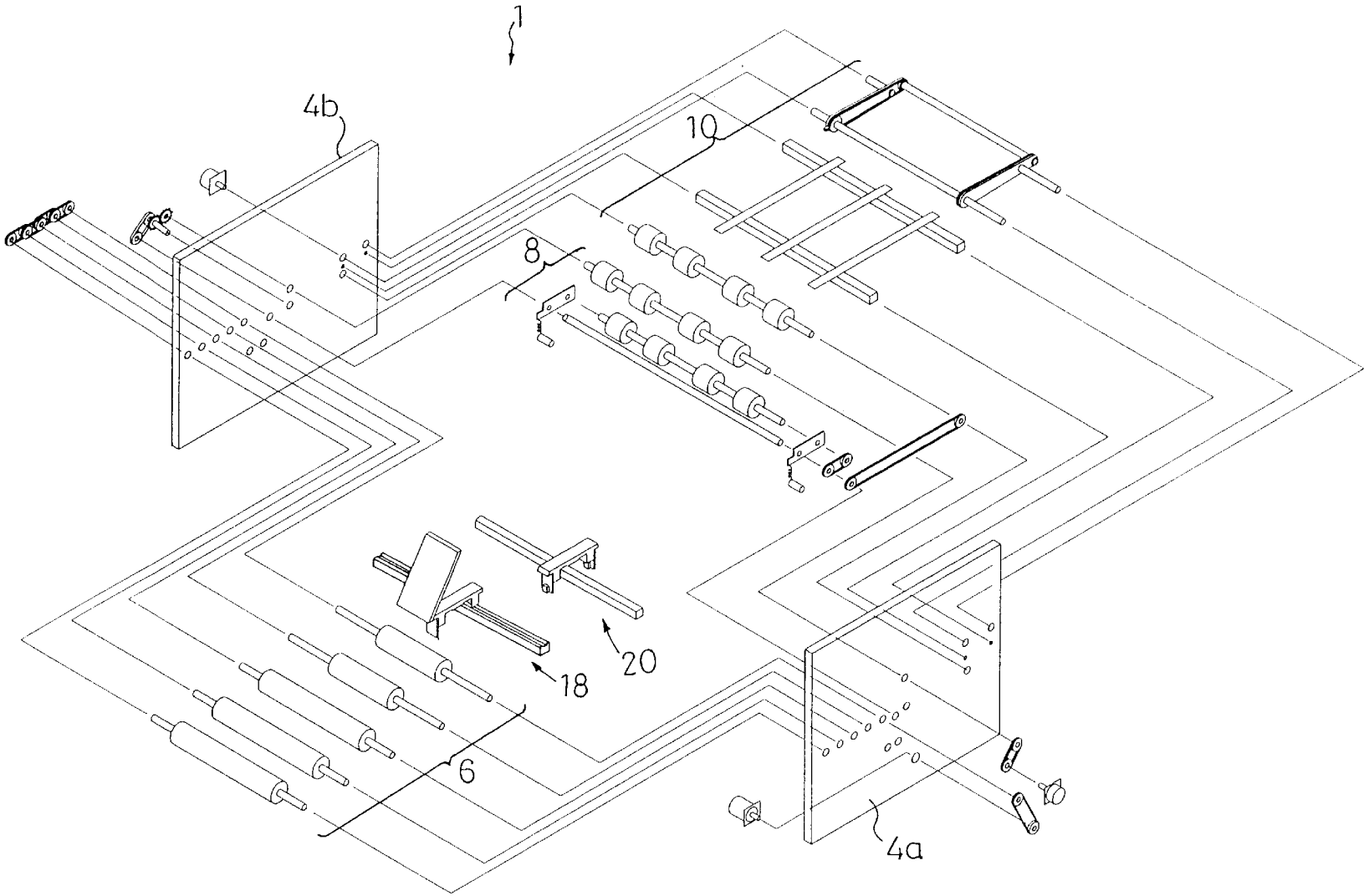
FIG. 1 is an exploded view of a media feeder according to the first embodiment of the present invention.
Figure 2:
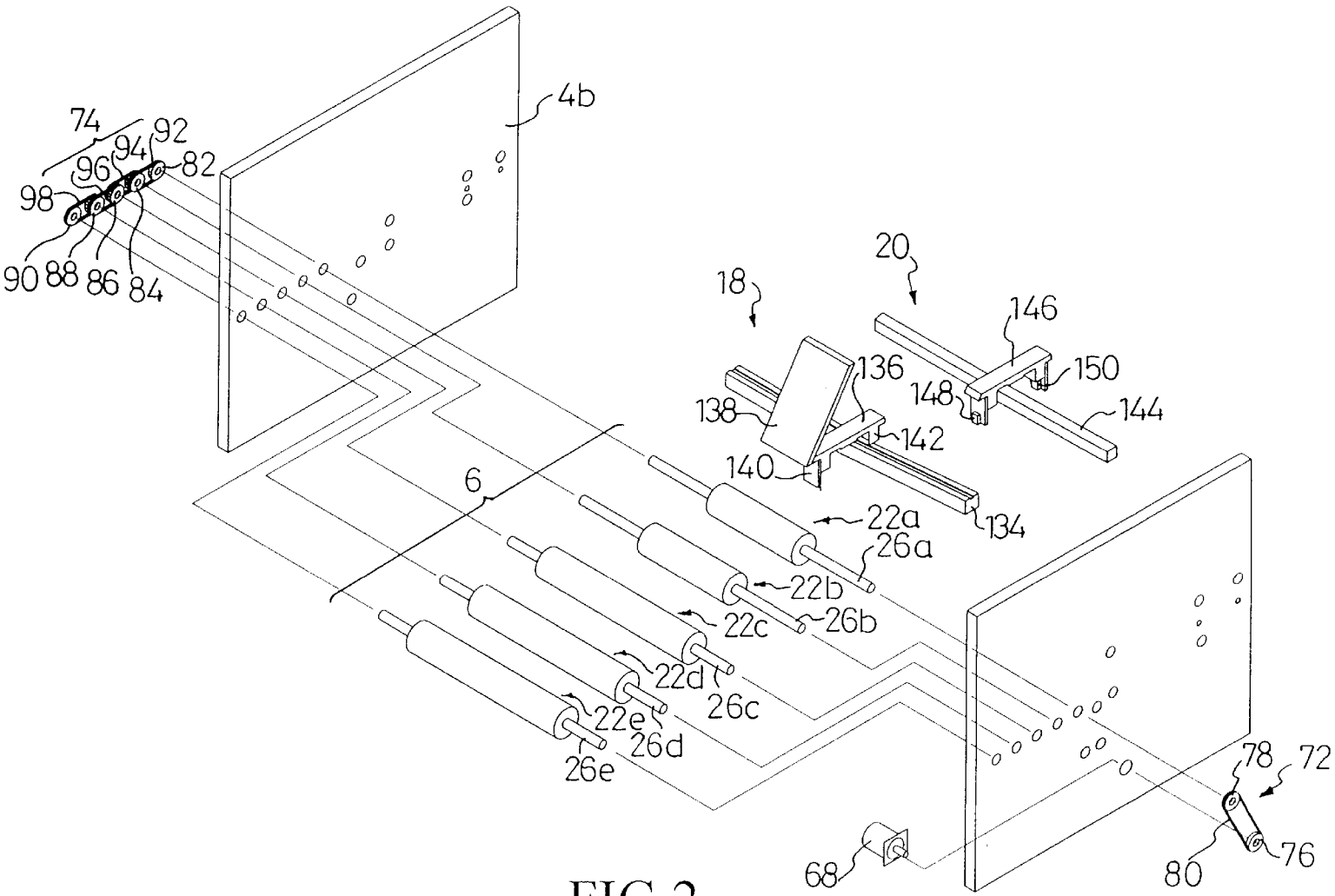
FIG. 2 is a partially enlarged view of FIG. 1.
Figure 3:
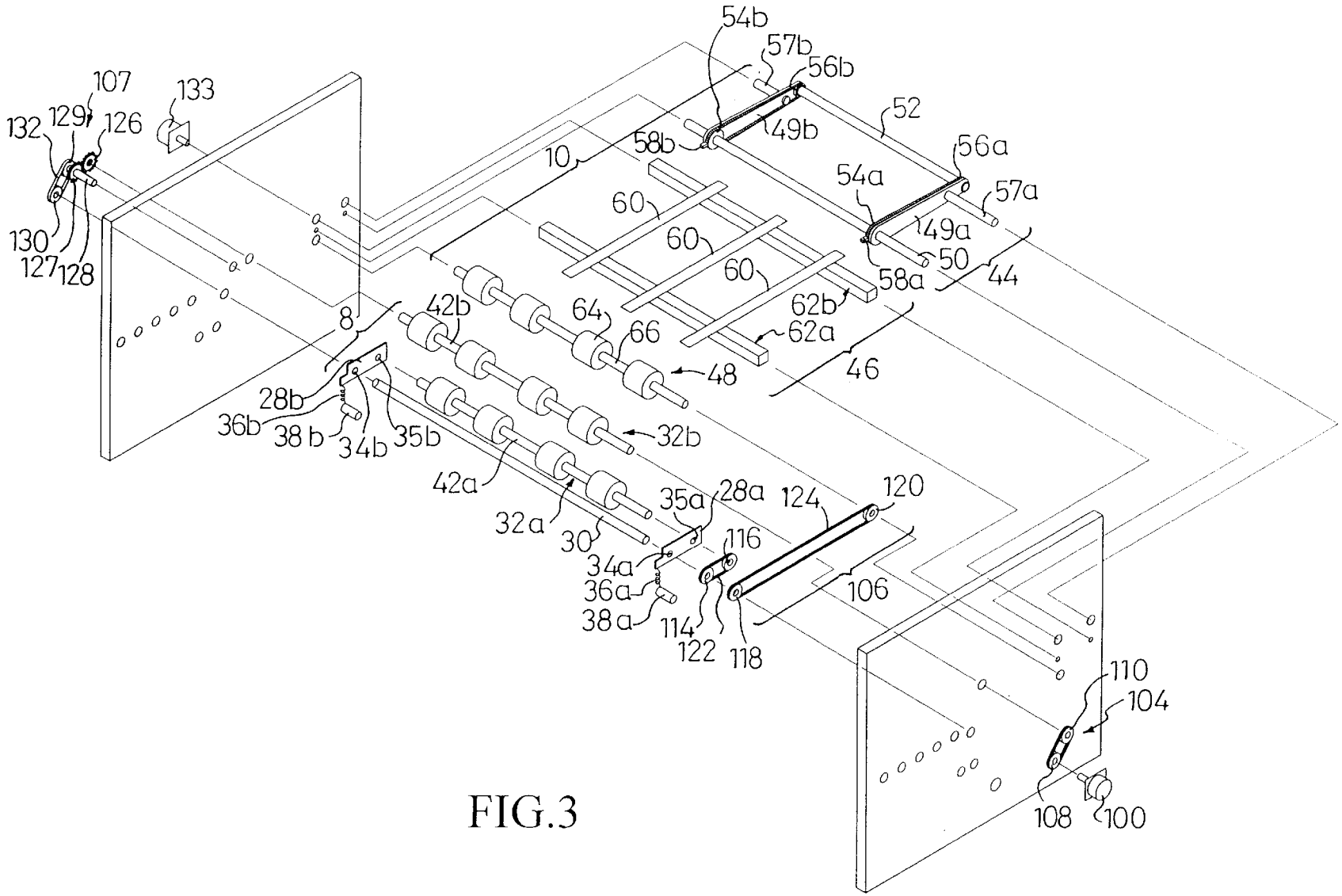
FIG. 3 is another partially enlarged view of FIG. 1.

FIG. 1 is an exploded view of a media feeder 1 according to the first embodiment of the present invention. FIG. 2 and FIG. 3 are partially enlarged views of FIG. 1. As shown in FIGS. 1 to 3, the media feeder 1 comprises a pair of parallel side plates 4*a*, 4*b*, a feed module 6, a transport module 8, a pusher module 10, a first driving mechanism, a second driving mechanism, a third driving mechanism, a separation module 18, and a sensor module 20. In addition, the operation of the media feeder 1 is controlled by a control unit (not shown).

The feed module 6 is disposed between the side plates 4*a*, 4*b* and comprises two or more feed rollers, preferably five feed rollers 22*a*, 22*b*, 22*c*, 22*d*, 22*e*. The feed rollers 22*a*, 22*b*, 22*c*, 22*d*, 22*e* each have at least one rolling wheel and are respectively provided with shafts 26*a*, 26*b*, 26*c*, 26*d*, 26*e* passing therethrough. The shafts 26*a*, 26*b*, 26*c*, 26*d*, 26*e* are rotatably supported by the side plates 4*a*, 4*b*. The feed rollers 22*a*, 22*b*, 22*c*, 22*d*, 22*e*, as shown in FIG. 2, are located on a horizontal plane and do not contact each other.

As shown in FIG. 3, the transport module 8 is disposed between the side plates 4*a*, 4*b* and located adjacent to the feed module 6. The transport module 8 includes a pair of parallel plates 28*a*, 28*b*, a bar 30 and two transport rollers 32*a*, 32*b*. The plates 28*a*, 28*b* each have two bores 34*a*, 35*a*; 34*b*, 35*b* and are respectively connected with compression springs 36*a*, 36*b* which are further connected with bars 38*a*, 38*b*, respectively. The bars 38*a*, 38*b* are supported by the side plates 4*a*, 4*b*, respectively. Two ends of the bar 30 pass through the bore 34*a*, 35*a* of the plates 28*a*, 28*b* and are rotatably supported by the side plates 4*a*, 4*b*, respectively. The transport rollers 32*a*, 32*b* each have at least one, preferably four rolling wheels and are respectively provided with shafts 42*a*, 42*b* passing therethrough. The shaft 42*a* of the transport roller 32*a* pass through the bore 35*a*, 35*b* of the plates 28*a*, 28*b*, respectively, and the transport roller 32*a* is rotatably supported by the plates 28*a*, 28*b*. The transport roller 32*b* is disposed above the transport roller 32*a*, and the shaft 42*b* thereof is rotatably supported by the side plates 4*a*, 4*b*. With the compression springs 36*a*, 36*b*, the bar 30 works as an axis of rotation to pull down an end of the plates 28*a*, 28*b* such that the transport roller 32*a* contacts the transport roller 32*b*.

The pusher module 10 is disposed between the side plates 4*a*, 4*b* and located adjacent to the transport module 8. The pusher module 10 comprises a belt assembly 44, a frame 46 and at least one pusher roller 48. The belt assembly 44 further comprises a pair of parallel side plates 49*a*, 49*b*, two parallel shafts 50, 52, two pulleys 54*a*, 54*b*, two belts 56*a*, 56*b* and two bars 57*a*, 57*b*. The shafts 50, 52 pass through the side plates 49*a*, 49*b*, individually. The pulleys 54*a*, 54*b* are attached to ends of the shaft 50 which is rotatably supported by the side plates 4*a*, 4*b*, and the bars 57*a*, 57*b* are outwardly disposed on the side plates 49*a*, 49*b*, respectively, and supported by the side plates 4*a*, 4*b* such that the belt assembly 44 can be supported by the side plates 4*a*, 4*b*. The belts 56*a*, 56*b* are fitted on the pulley 54*a*, 54*b* and the shafts 50, 52. A pair of protrusions 58*a*, 58*b* are provided on the outer surfaces of the belts 56*a*, 56*b*, respectively.

The frame 46 is located below the belt assembly 44 and is used for receiving a piece of paper. The frame 46 preferably comprises three parallel ribs 60 and two parallel beams 62*a*, 62*b* which are perpendicular to the ribs 60 and supported by the side plates 4*a*, 4*b*, whereby some spaces form within the frame 46. The pusher roller 48 is disposed below the frame 46 and comprises at least one, preferably four rolling wheels 64, and a shaft 66 which is rotatably supported by the side plates 4*a*, 4*b*. The rolling wheels 64 are aligned with the spaces formed within the frame 46 such that the rolling wheels 64 can contact the piece of paper loaded on the frame 46.

The first driving mechanism comprises a first motor 68 and a first transmission mechanism having a first pulley set 72 and a second pulley set 74. The first motor 68, preferably a step motor, is disposed adjacent to the inside surface of the side plate 4*a* and electrically connected to the control unit. The first pulley set 72 is disposed adjacent to the outside surface of the side plate 4*a* and has two separate pulleys 76, 78 and a belt 80 fitted on the pulleys 76, 78. The pulley 76 is connected to the first motor 68, and the pulley 78 is connected to the shaft 26*a* of the feed roller 22*a*. The second pulley set 74 is disposed adjacent to the outside surface of the side plate 4*b* and has five separate pulleys 82, 84, 86, 88, 90 connected to the shafts 26*a*, 26*b*, 26*c*, 26*d*, 26*e* of the feed rollers 20*a*, 20*b*, 20*c*, 20*d*, 20*e*, respectively, and four belts 92, 94, 96, 98 fitted on the pulleys 82–84, 84–86, 86–88, 88–90, respectively. The first motor 68 can drive the feed rollers 20*a*, 20*b*, 20*c*, 20*d*, 20*e* to rotate synchronously in the same direction.

The second driving mechanism comprises a second motor 100 and a second transmission mechanism having a first pulley set 104, a second pulley set 106 and a third pulley set 107. The second motor 100, preferably a step motor, is disposed adjacent to the outside surface of the side plate 4*a* and electrically connected to the control unit. The first pulley set 104 is disposed adjacent to the outside surface of the side plate 4*a* and has two separate pulleys 108, 110 and a belt 112 fitted on the pulleys 108, 110. The pulley 108 is connected to the second motor 100, and the pulley 110 is connected to the shaft 42*b* of the transport roller 32*b*. The second pulley set 106 is disposed between the side plate 4*a* and plate 28*a* and has four pulleys 114, 116, 118, 120 and two belts 122, 124. The belt 122 is fitted on the pulleys 114, 116, and the belt 124 is fitted on the pulleys 118, 120. The third pulley set 107 is disposed adjacent to the outside surface of the side plate 4*b* and has two gears 126, 127, a bar 128, two separate pulleys 129, 130 and a belt 132 fitted on the pulleys 129, 130. A pair of gears 126, 127 are engaged with each other. The gear 127 and the pulley 129 are secured to the bar 128 which is rotatably supported by the side plate 4*b*.

As shown in FIG. 3, an end of the bar 30 passes through the plate 28*a*, the pulleys 114, 118 and then rotatably supported by the side plate 4*a*. The other end of the bar 30 passes through the plate 28*b*, the side plate 4*b* and the pulley 130. An end of the shaft 42*a* passes through the plate 28*a* and is connected to the pulley 116. The other end of the shaft 42*a* passes through the plate 28*b*. An end of the shaft 42*b* passes through the side plate 4*a* and is connected to the pulley 110. The other end of the shaft 42*b* passes through the side plate 4*b* and is connected to the gear 126. An end of the shaft 66 passes through the pulley 120 and is rotatably supported by the side plate 4*a*. The other end of the shaft 66 is rotatably supported by the side plate 4*b*. Accordingly, the second motor 100 can drive the transport roller 32*a*, 32*b* to rotate synchronously in the opposite direction. Further, the transport roller 32*a* and the pusher roller 48 rotate synchronously in the same direction.

The third driving mechanism comprises a third motor 133 and a third transmission mechanism. The third motor 133 is disposed adjacent to the outside surface of the side plate 4*b* and electrically connected to the control unit. The third motor 133 is further connected to the third transmission mechanism, in this embodiment, to the bar 50 of the belt assembly 44. Therefore, the third motor 133 can drive the bar 50 such that the belts 56*a*, 56*b* rotate synchronously in the same direction.

Figure 4:
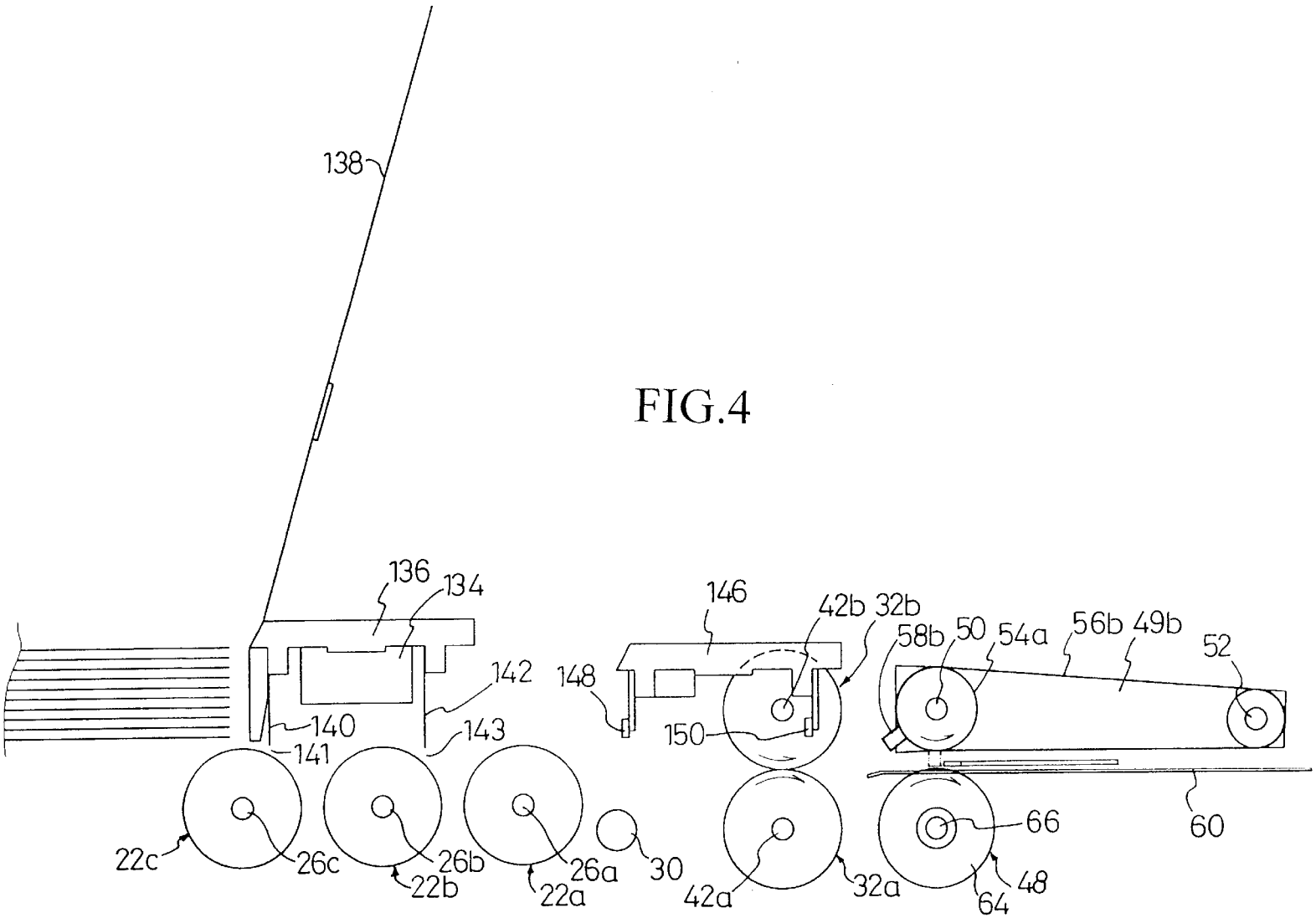
FIG. 4 is a side view of a media feeder according to the first embodiment of the present invention.

As shown in FIG. 2 and FIG. 4, the separation module 18 is disposed adjacent to the feed module 6 and between the side plates 4*a*, 4*b*. The separation module 18 comprises a beam 134, a plate 136, a slopped plate 138 and at least one, preferably two tabs 140, 142. The beam 134 is supported by the side plates 4*a*, 4*b*. The plate 136 is perpendicularly disposed on the beam 134. The slopped plate 138 is connected to an end of the plate 136. The tabs 140, 142 extend from the bottom of the plate 136 and are used to avoid the condition of "multiple feed." The tab 140 is located above the feed roller 22*c* and a gap 141 therebetween can be adjustable by adjusting means (not shown) such that only one piece of paper can pass through the gap 141. The tab 142 is located above the feed roller 22*b* and a gap 143 therebetween is also adjustable to further avoid "multiple feed."

The sensor module 20 is located adjacent to the transport module 8 and between the side plates 4*a*, 4*b*. The sensor module 20 comprises a beam 144, a plate 146, a first sensor 148 and a second sensor 150. The beam 144 is supported by the side plates 4*a*, 4*b*. The plate 146 is perpendicularly disposed on the beam 144. The first sensor 148 and the second sensor 150 are disposed under two ends of the plate 146, respectively. The first sensor 148 is used as a counter and the second sensor 150 is used to measure the length of a piece of paper passing therethrough.

The control unit is preferably a central processing unit such as Intel 80C32® and the sensors 148, 150 are preferably the reflectance-typed sensors. To facilitate understanding the operation of the media feeder, the functional relationships among elements of the above embodiment underlying the subject invention are hereinafter described. First, the gaps 141, 143 are adjusted so that only one piece of paper can pass therethrough and a stack of paper is placed against the slopped plate 138. Further, the control unit is actuated to effect the operation of the first motor 68, and the feed rollers 22*a*, 22*b*, 22*c*, 22*d*, 22*e* then start rotating. The bottom piece of paper is moved by the feed rollers 22*a*, 22*b*, 22*c*, 22*d*, 22*e*. As the first sensor 148 detects the bottom piece of paper, after 0.2 second, the second motor 100 is actuated and the transport rollers 32*a*, 32*b*, as well as the pusher roller 48, start rotating. After running 0.2 second, the first motor 68 stops and the second motor 100 reminds running. The piece of paper is then moved by the transport rollers 32*a*, 32*b* and the pusher roller 48. When the second sensor 150 detects the front edge of the piece of paper, it starts measuring the length of the paper until it detects the rear edge of the paper. The length of the paper is then obtained, which is converted to the number of steps (N steps) by the control unit. After the conversion to N steps, the first motor 68 stops, and the piece of paper has reached and rests on the frame 46. At this moment, the third motor 16 starts running. The protrusions 58*a*, 58*b* of the belts push the edge of the paper to a printer (not shown). After the third motor 133 has run for 0.1 second, the control unit activates the first motor 68 again. Another cycle for feeding the piece of paper is then initiated.

Figure 5:
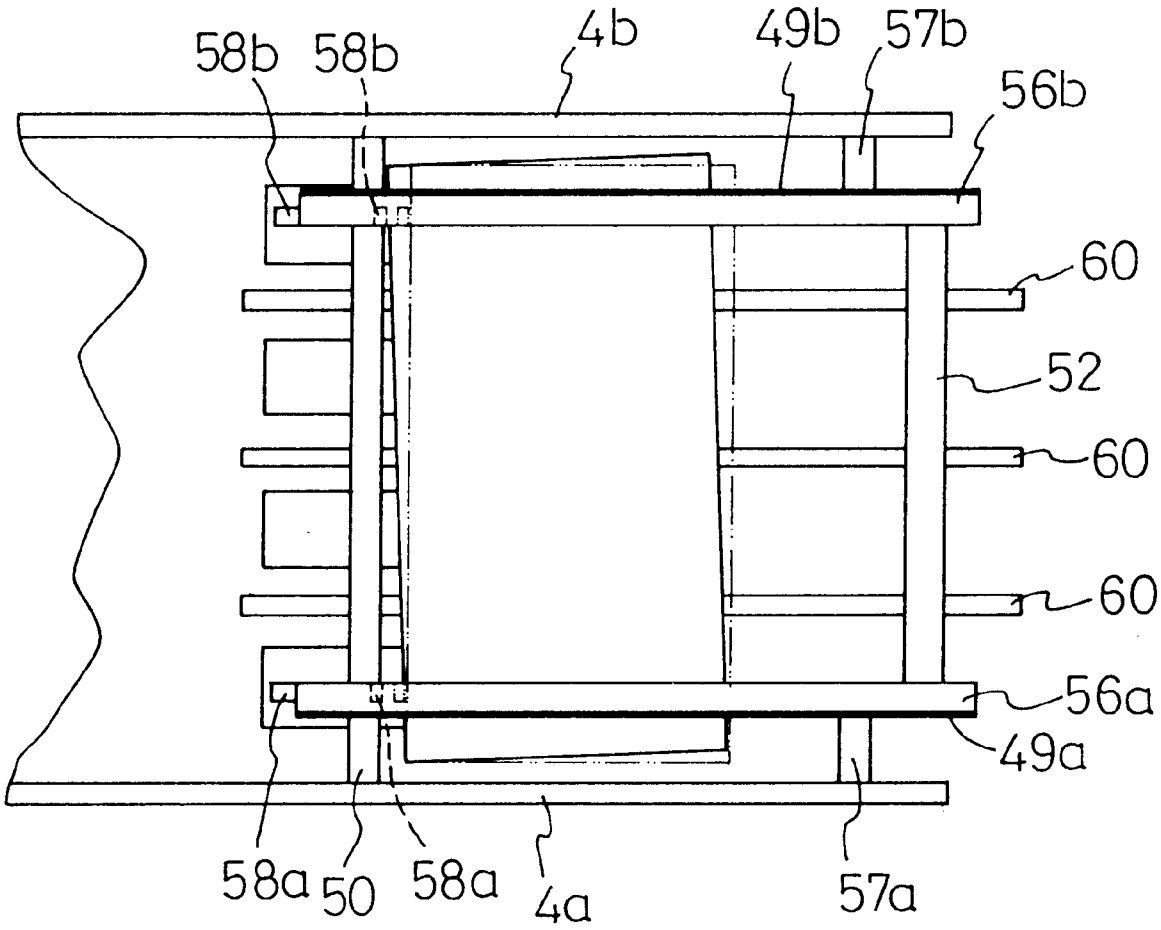
FIG. 5 is a top view showing the misalignment correction process according to the first embodiment of the present invention.

As shown in FIG. 4 and FIG. 5, since the protrusions 58*a*, 58*b* correspond with each other, even though the paper transported from the transport module 8 is misaligned, the movement of the protrusions 58*a*, 58*b* can gradually correct the misalignment such that the piece of paper can be delivered to the printer appropriately and is thereby not misfed.

Figure 6:
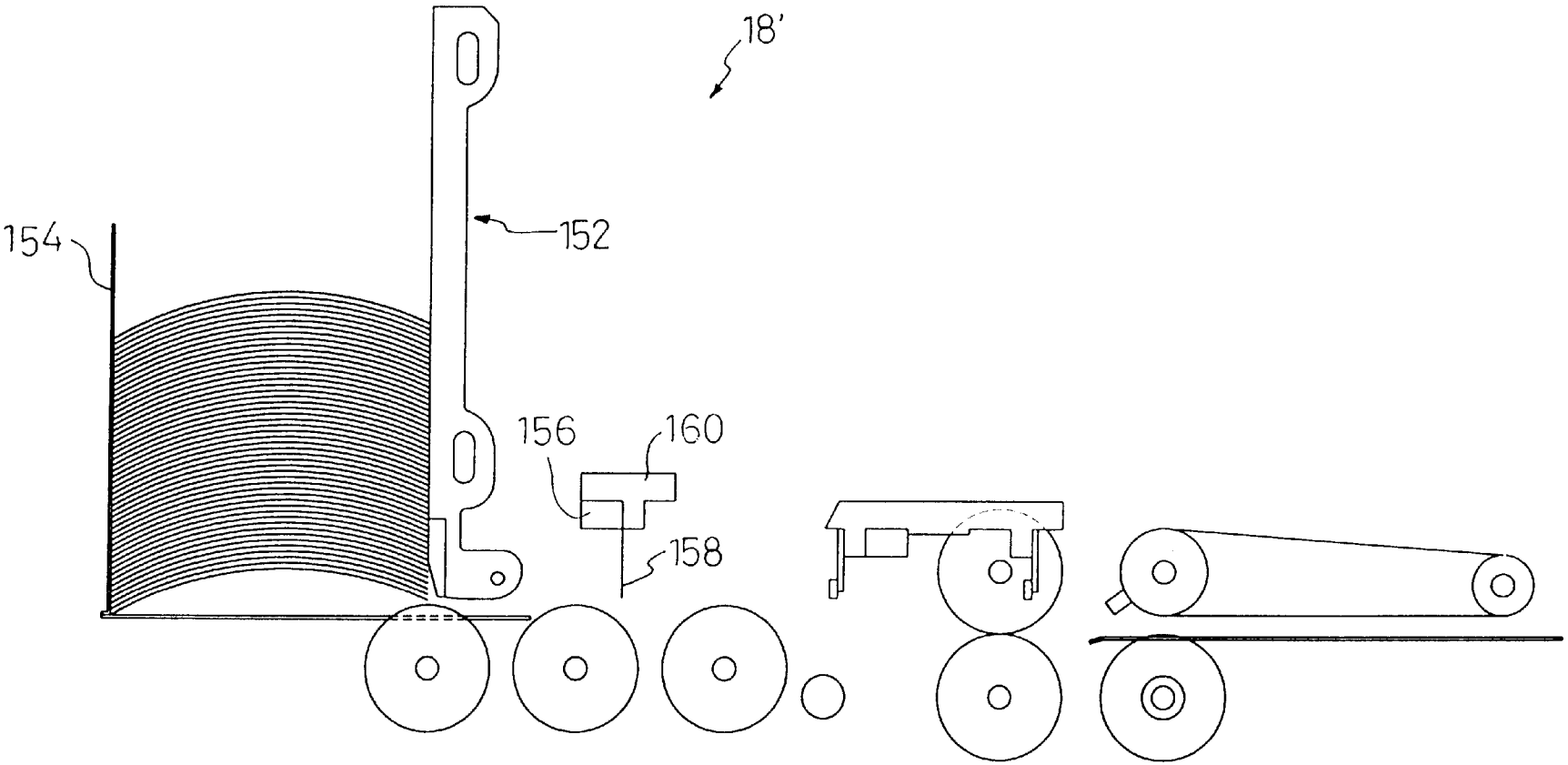
FIG. 6 is a side view of a media feeder according to the second embodiment of the present invention.
Figure 7:
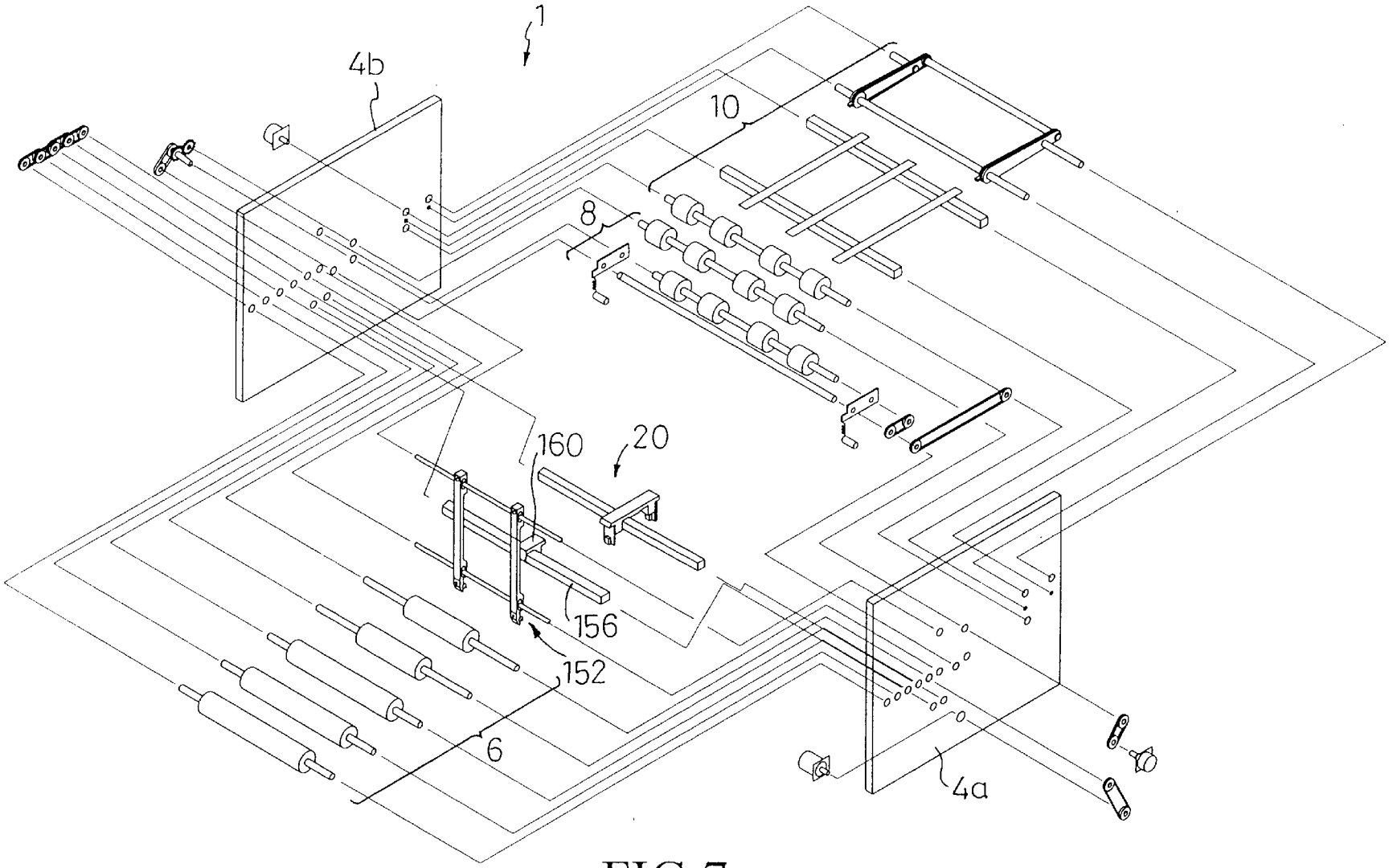
FIG. 7 is an exploded view of a media feeder according to the second embodiment of the present invention with the paper tray omitted.

FIG. 6 shows the second embodiment of the present invention wherein the separation module 18' comprises a vertical frame 152, a paper tray 154, a beam 156 and a seat 160. The vertical frame 152 and the beam 156 are supported by the side plates 4*a*, 4*b*. The beam 156 is disposed at a side where a piece of paper leaves the vertical frame 152, and the seat 160 is attached to the beam 156. A tab 158 further extends downward from the seat 160. The paper tray 154 is located at the other side of the vertical frame 152 and manually movable toward the vertical frame 152 so as to buckle a stack of paper between the paper tray 154 and the vertical frame 152 in a convex shape.

With the separation module 18' according to the second embodiment, the weight of the stack of paper above the bottom piece of paper can be reduced. By adjusting the position of paper tray 154, a static balance is established by the weight above the bottom piece of paper and the upward frictional forces generated between the edge of the stack of paper and vertical frame 152 and between the other edge of the stack and the wall of paper tray 154. At this moment, each piece of paper is independently supported by the vertical frame 152 and the wall of paper tray 154, and thus the bottom piece of paper will not "feel" the weight of the paper above it. The bottom piece of paper can fall freely in an acceleration of 1 g (9.8 m/sec$^2$) and no "multiple feed" occurs.

Although the present invention has been described with respect to the preferred embodiments thereof, various changes and applications can be made by those skilled in the art without departing from the technical concepts of the present invention. The present invention is not limited to the particular details as described in the preferred embodiments. Therefore, it is intended that all such changes of certain features of the preferred embodiments which do not alter the overall basic functions and the concepts of the present invention are within the scope defined in the appended claims.

We claim:

1. A media feeder comprising:

a control unit;

a pair of side plates;

a feed module disposed between said pair of side plates;

a transport module disposed between said pair or side plates and located adjacent to said feed module, at a side where a piece of paper leaves said feed module;

a pusher module disposed between said pair of side plates and located adjacent to said transport module, at a side where a piece of paper leaves said transport module;

a first driving mechanism having a first motor and a first transmission mechanism, said first motor being connected to said first transmission mechanism and being electrically connected to said control unit, and said first transmission mechanism being connected to said feed module;

a second driving mechanism having a second motor and a second transmission mechanism, said second motor being connected to said second transmission mechanism and being electrically connected to said control unit, and said second transmission mechanism being connected to said transport module;

a third driving mechanism having a third motor and a third transmission mechanism, said third motor being connected to said third transmission mechanism and being electrically connected to said control unit, and said third transmission mechanism being connected to said pusher module;

a separation module disposed adjacent to said feed module and between said side plates; and a sensor module disposed adjacent to said transport module and between said side plates and electrically connected to said control unit.

2. The media feeder according to claim 1, wherein said feed module comprises two or more separate feed rollers rotatably supported by said side plates.

3. The media feeder according to claim 1, wherein said transport module comprises two or more separate transport rollers rotatably supported by said side plates.

4. The media feeder according to claim 1, wherein said pusher module comprises a belt assembly and at least one pusher roller disposed under said belt assembly and rotatably supported by said side plates.

5. The media feeder according to claim 4, wherein said belt assembly comprises two or more parallel shafts supported by said side plates and two or more belts each having a protrusion and fitted on said shafts, said protrusions corresponding to each other.

6. The media feeder according to claim 1, wherein said separation module comprises a slopped plate, a horizontal plate extending from said slopped plate, and at least one tab extending downward from said horizontal plate, and wherein said separation module is supported by said pair of side plates.

7. The media feeder according to claim 1, wherein said separation module comprises a vertical frame, a paper tray and a beam, said vertical frame and said beam being supported by said side plate, said beam being disposed at a side where a piece of paper leaves said vertical frame, said paper tray being located at the other side of said vertical frame and being movable toward said vertical frame so as to buckle a stack of paper between said paper tray and said vertical frame in a convex shape, and wherein said separation module further comprises a seat attached to said beam, said seat having a tab extending therefrom.

8. The media feeder according to claim 1, wherein said sensor module has a horizontal plate, a first sensor and a second sensor, said horizontal plate being supported by said side plates, and said first and second sensors being disposed in said horizontal plate in a direction parallel to said side plates and opposite to the direction of paper feed.

* * * * *